US010920525B2

(12) United States Patent
Tveranger

(10) Patent No.: US 10,920,525 B2
(45) Date of Patent: Feb. 16, 2021

(54) SELF CALIBRATING TOE VALVE

(71) Applicant: TCO AS, Bergen (NO)

(72) Inventor: Jan Tore Tveranger, Garnes (NO)

(73) Assignee: TCO AS, Bergen (NO)

( * ) Notice: Subject to any disclaimer, the term of this patent is extended or adjusted under 35 U.S.C. 154(b) by 291 days.

(21) Appl. No.: 16/301,362

(22) PCT Filed: May 23, 2017

(86) PCT No.: PCT/NO2017/050128
§ 371 (c)(1),
(2) Date: Nov. 13, 2018

(87) PCT Pub. No.: WO2017/204657
PCT Pub. Date: Nov. 30, 2017

(65) Prior Publication Data

US 2019/0195048 A1 Jun. 27, 2019

(30) Foreign Application Priority Data

May 25, 2016 (NO) ..... 20160892

(51) Int. Cl.
*E21B 34/10* (2006.01)
*E21B 34/14* (2006.01)
(Continued)

(52) U.S. Cl.
CPC ..... *E21B 34/10* (2013.01); *E21B 23/04* (2013.01); *E21B 34/14* (2013.01); *E21B 41/00* (2013.01);
(Continued)

(58) Field of Classification Search
CPC ..... E21B 34/08; E21B 34/085; E21B 34/101; E21B 34/108; E21B 34/125; E21B 34/14; E21B 2200/06; E21B 23/04
See application file for complete search history.

(56) References Cited

U.S. PATENT DOCUMENTS

2013/0118758 A1 5/2013 Caminari
2016/0237785 A1 8/2016 Bacsik et al.

FOREIGN PATENT DOCUMENTS

NO 20140616 5/2014
WO 9706344 2/1997
WO 2015109407 7/2015

OTHER PUBLICATIONS

International Search Report of PCT Application No. PCT/NO2017/050128 dated Sep. 12, 2017: pp. 1-2.

*Primary Examiner* — Giovanna Wright
*Assistant Examiner* — Ronald R Runyan
(74) *Attorney, Agent, or Firm* — Flener IP & Business Law; Zareefa B. Flener

(57) ABSTRACT

A toe valve that includes a housing having an interior and exterior; a sliding sleeve; a counter mechanism that includes a cylinder, a ratchet piston with first and second ends, and a ratchet shaft connected to the second end; a trigger assembly that includes a trigger housing, and a release piston. The trigger assembly is arranged between the counter mechanism and the sliding sleeve, and the release piston is configured to activate the sliding sleeve, and the ratchet shaft is configured to activate the release piston. The toe valve further includes a closed chamber enclosing the ratchet shaft and defined at least partly by the cylinder that includes a chamber fluid with a chamber pressure; an inlet pressure port configured to be in communication with a wellbore fluid with a wellbore pressure, and the first end of the ratchet piston is in fluid communication with the inlet pressure port.

21 Claims, 3 Drawing Sheets

(51) Int. Cl.
*E21B 23/04* (2006.01)
*E21B 41/00* (2006.01)
*E21B 34/06* (2006.01)

(52) U.S. Cl.
CPC ..... *E21B 34/063* (2013.01); *E21B 2200/04* (2020.05); *E21B 2200/06* (2020.05)

SELF CALIBRATING TOE VALVE

FIELD OF THE INVENTION

The invention relates to a self-calibrating Toe Valve installed as a part of casing string in a horizontal wellbore.

BACKGROUND OF THE INVENTION

The present invention relates to a downhole tool with a sliding sleeve that is shifted into open position using a predetermined pressure operated cycling sequence. The downhole tool may be installed as a part of a casing string in a horizontal wellbore. Normally, after a casing is installed in a wellbore, it is pressure tested to verify the seal integrity. Test operations may include installing two or more plugs in different locations of a wellbore increasing fluid pressure from the surface in order to record possible leaks between the plugs. Typically, a pressure drop in and/or a loss fluid between the plugs will be a sign of breached well integrity. After casing pressure test, a port is opened in the toe of the well in order to pump down equipment, example equipment for fracking. Toe valves are typically used for this purpose. Toe valves are initially closed, but they can be opened to stimulate various intervals in the well.

Different types of Toe valves are disclosed in US2016/0237785 A1. In particular US2016/0237785 A1 discloses a downhole tool that is actuatable in response to applied pressure. The tool has a housing, an insert, and an indexer. The housing defines a housing bore therethrough and defines at least one port communicating the housing bore outside the housing. The housing has a communication path extending from a first part of the housing bore to a second part of the housing bore. The insert is movably disposed in the housing bore and sealably encloses the second part of the communication path. The insert is movable from a first position covering the at least one port to a second position uncovering the at least one port.

The indexer is disposed in the communication path and is movably responsive to the applied pressure at the first part of the communication path. The indexer counts a number of applications of the applied pressure and permits fluid communication of the applied pressure from the first part to the second part in response to the counted number. At least a portion of the insert acted upon by the applied fluid pressure in the second part initiates movement of the insert from the first position to the second position.

The indexer includes a piston having first and second piston portions. The first piston portion is movably responsive to the applied pressure at the first part and moves the second piston portion relative to sealed engagement with the second part. The first piston portion includes a ring movably disposed in a first internal space of the first part. The second piston portion includes at least one rod connected to the ring and movable therewith. The at least one rod in a first condition prevents communication of the applied pressure from the first internal space to the second part of the communication path and in a second condition permits the communication of the applied pressure from the first internal space to the second part.

It is well known to use an indexer for enabling activation of various well equipment to initiate a necessary action, and where the equipment is activated by pulsing or cycling the pressure of the fluid that is in the well. Normally, such indexers are constructed by a counting and step construction (counter system) where a piston or the like displaces a toothed rod, ratchet, shaft or the like a given distance each time the operator on the surface increases the fluid pressure in the well, with such a pressure increase being followed by a pressure release. When the rod, after a given number of such pulses with high/low fluid pressure, has been moved a sufficient distance forwards, activation of various equipment in a hydrocarbon well is enabled.

Conventional counter systems largely must be calibrated to specific well conditions and may fail to work if pressure conditions in a well change or are otherwise outside the pressure intervals under which the calibrated trigger system is set to work.

With the help of the counter system, the time of activation can be accurately predicted as it is based on the number of pressure cycles to the release and not on the level of fluid pressure. However, these systems can still be improved.

Calibrating a trigger system is a time-demanding operation, as each tool must be calibrated for the specific well conditions. In addition, well conditions may change, thereby moving the pressure and temperature conditions outside the operating pressure window of the trigger systems.

Today's systems also require that the pipe has a higher material thickness to solve the problem, as one traditionally needs to use a very powerful spring or a nitrogen chamber to compensate for the hydraulic fluid pressure of the well.

Therefore, it is an aim of the invention to provide a new construction that can eliminate the need for calibration of the Toe valve tool for each individual well in which the Toe Valve is to be used.

Furthermore, it is an aim to provide a Toe Valve system that is self-calibrating based on hydrostatic pressure.

Furthermore, it is an aim to be able to contribute to maintaining the pressure that must be applied from the surface to the pipe at the same level, regardless of the depth and temperature in which the toe valve is fitted.

At least one of these aims is achieved by the device indicated in the enclosed independent claim 1. Other favorable or possible embodiments are indicated in the dependent claims.

SUMMARY OF THE INVENTION

A toe valve comprising; a housing having an interior and exterior; a sliding sleeve; a counter mechanism comprising a cylinder, a ratchet piston with first and second ends, and a ratchet shaft connected to the second end; a trigger assembly comprising a trigger housing, and a release piston, wherein the trigger assembly is arranged between the counter mechanism and the sliding sleeve; and wherein the release piston is configured to activate the sliding sleeve, and the ratchet shaft is configured to activate the release piston; wherein the toe valve further comprises a closed chamber enclosing the ratchet shaft and defined at least partly by the cylinder comprising a chamber fluid with a chamber pressure (P2); an inlet pressure port configured to be in communication with a wellbore fluid with a wellbore pressure (P1), and wherein the first end of the ratchet piston is in fluid communication with the inlet pressure port, wherein the ratchet piston is configured to move towards the trigger assembly to a new position and compress the chamber fluid when the wellbore pressure (P1) is larger than the chamber pressure (P2); a retaining mechanism configured to retain the ratchet shaft in the new position, and; a valve mechanism interconnecting the first and second ends of the ratchet piston and configured for equalizing the pressure across the ratchet piston.

In one embodiment of the invention the toe valve further comprises at least one frack port having a perforation extending from the interior of the housing to the exterior of the housing wherein the sliding sleeve is arranged to cover the at least one frack port.

In one embodiment of the invention the valve mechanism is arranged within the ratchet piston.

In one embodiment of the invention the valve mechanism comprises a valve configured to prevent fluid flow in a first direction from inlet pressure port to the closed chamber and allow fluid flow in a second opposite the first direction.

In one embodiment of the invention the valve is one-way relief valve. The valve may comprise a ball arranged to rest on a seat. The valve may be configured to open when the ball is moved away from the seat.

In one embodiment of the invention the valve mechanism comprises a first one-way valve and a second one-way valve each having one end in fluid communication with the closed chamber and another end in pressure communication with the inlet pressure port, wherein the first and the second one-way valves are arranged in opposite directions.

In one embodiment of the invention the valve mechanism is configured to equalize pressure in the closed chamber when a predetermined differential pressure value between P1 and P2 is exceeded.

In one embodiment of the invention the first valve is configured to open when pressure at the inlet pressure port is a predetermined value greater than the chamber pressure in the closed chamber.

In one embodiment of the invention the second valve is configured to open when wellbore pressure (P1) at the inlet pressure port is a predetermined value less than the chamber pressure (P2) in the closed chamber.

In one embodiment of the invention the fluid in the closed chamber is a compressible fluid and the compressible fluid in the closed chamber is silicone oil.

In one embodiment of the invention the cylinder further comprises a retaining member configured to limit movement of the ratchet shaft towards the inlet pressure port. In another embodiment of the invention the cylinder further comprises a retaining shoulder configured to limit the movement of the ratchet piston towards the closed chamber.

In one embodiment of the invention the toe valve further comprising an activation pin configured to release the release piston, and a first atmospheric chamber arranged between the trigger assembly and the sliding sleeve, wherein the release piston is configured to compress the first atmospheric chamber when released by the activation pin.

In one embodiment of the invention the toe valve further comprises pressure equalization channel which extends from the inlet pressure port and beyond the ratchet piston assembly.

In one embodiment of the invention the toe valve further comprises a second atmospheric chamber arranged opposite the first atmospheric chamber relative to the sliding sleeve, wherein the sliding sleeve is configured to move in response to pressure difference between the first atmospheric chamber and the second atmospheric chamber.

It is also provided a method of opening toe valve comprising; a housing having an interior and exterior; a sliding sleeve, a counter mechanism comprising a cylinder, a ratchet piston with first and second ends, and a ratchet shaft connected to the second end; a trigger assembly comprising a trigger housing, and a release piston, wherein the trigger assembly is arranged between the counter mechanism and the sliding sleeve; and wherein the toe valve further comprises a closed chamber enclosing the ratchet shaft and defined at least partly by the cylinder comprising a chamber fluid with a chamber pressure (P2); an inlet pressure port configured to be in communication with a wellbore fluid with a wellbore pressure (P1), and wherein the first end of the ratchet piston is in fluid communication with the inlet pressure port; a retaining mechanism, and a valve mechanism interconnecting the first and second ends of the ratchet piston, the method comprising the steps of;

activating the counter mechanism, wherein the activation of the counter mechanism comprising the steps of;

a) increasing wellbore pressure (P1) at the inlet pressure port to push the ratchet piston towards the trigger assembly whereby the ratchet piston compresses the fluid in the closed chamber, and to move the ratchet shaft is to a new position;

b) retaining the ratchet shaft in the new position by the retaining mechanism;

c) continue increasing wellbore pressure (P1);

d) decreasing the wellbore pressure (P1) lower than chamber pressure (P2);

e) open the valve mechanism to equalize pressure across the ratchet piston by releasing fluid from the closed chamber;

f) repeating steps a) to e) until the ratchet shaft engages with the activation pin and forces the activation pin from its position towards the release piston;

Activating the trigger assembly, wherein the activation of the trigger assembly comprising the steps of;

pushing the release piston with the activation pin towards the first atmospheric chamber, thereby increasing the pressure in the atmospheric chamber;

pushing the sliding sleeve away from the at least one frack port towards the second atmospheric chamber with the release piston;

It is also provided a method of opening toe valve comprising; a housing having an interior and exterior; a sliding sleeve, a counter mechanism comprising a cylinder, a ratchet piston with first and second ends, and a ratchet shaft connected to the second end; a trigger assembly comprising a trigger housing, and a release piston, wherein the trigger assembly is arranged between the counter mechanism and the sliding sleeve; and wherein the toe valve further comprises a closed chamber enclosing the ratchet shaft and defined at least partly by the cylinder comprising a chamber fluid with a chamber pressure (P2); an inlet pressure port configured to be in communication with a wellbore fluid with a wellbore pressure (P1), and wherein the first end of the ratchet piston is in fluid communication with the inlet pressure port; a retaining mechanism, and a valve mechanism interconnecting the first and second ends of the ratchet piston, the method comprising the steps of;

activating the counter mechanism, wherein the activation of the counter mechanism comprising the steps of;

a) increasing wellbore pressure (P1) at the inlet pressure port to push the ratchet piston towards the trigger assembly whereby the ratchet piston compresses the fluid in the closed chamber, and to move the ratchet shaft is to a new position;

b) retaining the ratchet shaft in the new position by the retaining mechanism;

c) continue increasing wellbore pressure (P1) in such that P1 is a predetermined pressure difference greater than chamber pressure (P2);

d) open a first valve of the valve mechanism to equalize pressure across the ratchet piston by allowing fluid into the closed chamber;

e) decreasing the wellbore pressure (P1) a predetermined pressure difference lower than chamber pressure (P2);

f) open a second valve of the valve mechanism to equalize pressure across the ratchet piston by releasing fluid from the closed chamber;

g) repeating steps a) to f) until the ratchet shaft engages with the activation pin and forces the activation pin from its position towards the release piston;

Activating the trigger assembly, wherein the activation of the trigger assembly comprising the steps of;

pushing the release piston with the activation pin towards the first atmospheric chamber, thereby increasing the pressure in the atmospheric chamber;

pushing the sliding sleeve away from the at least one frack port towards the second atmospheric chamber with the release piston;

In one embodiment of the invention, in step f), the ratchet piston is pushed back to its start position and the ratchet shaft is retained by the retaining mechanism.

BRIEF DESCRIPTION OF THE DRAWINGS

These and other possible alternative or advantageous embodiments of the invention will become clear from the following detailed description of an embodiment, given as non-limiting examples, with reference to the attached schematic drawings, wherein.

DETAILED DESCRIPTION

Figure 1:
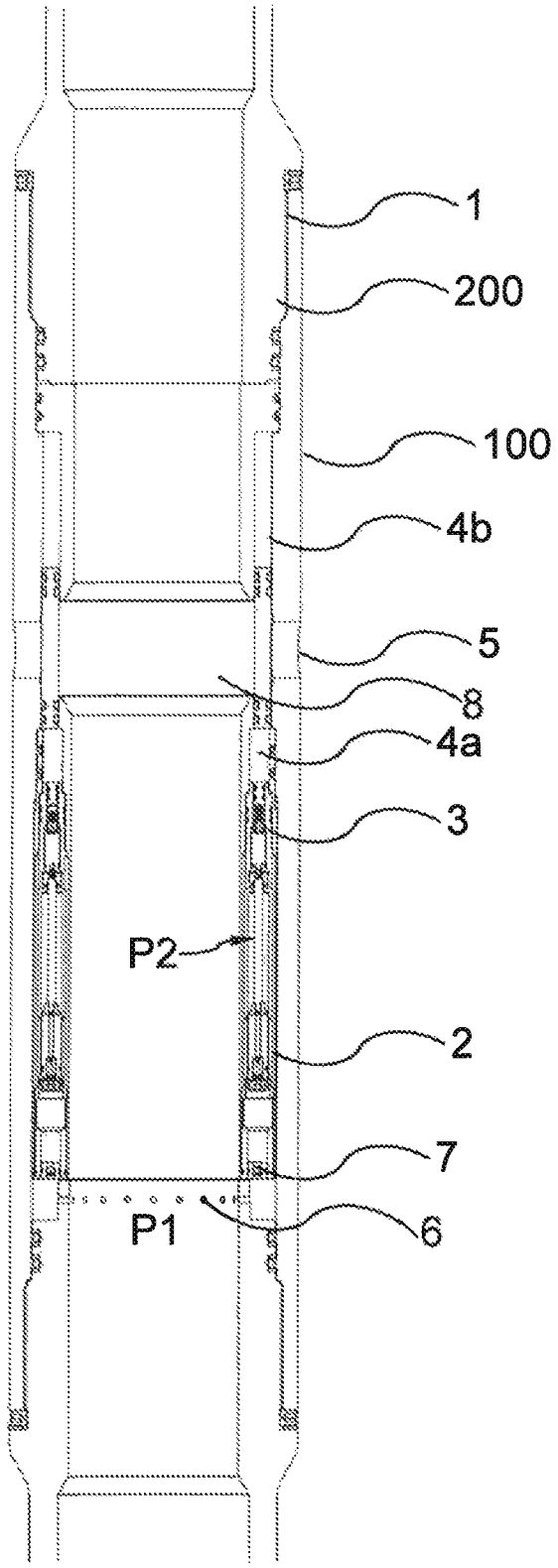
FIG. 1 shows the device according of the invention.

The following description may use terms such as "horizontal", "vertical", "lateral", "back and forth", "up and down", "upper", "lower", "inner", "outer", "forward", "rear", etc. These terms generally refer to the views and orientations as shown in the drawings and that are associated with normal use of the invention. The terms are used for the reader's convenience only and shall not be limiting.

In one embodiment of the invention, the toe valve device 1 is shown in FIG. 1. The device 1 is inserted in a tubing 100, the device comprises a housing 200 defining a housing bore comprising a self-calibrating counter mechanism 2, a sliding sleeve 8 covering at least one frack port 5 in a closed configuration and uncovering at least one frack port 5 in an open configuration, at least one frack port is in communication outside the housing 200, a trigger assembly 3 which is configured to open and activate the sliding sleeve 8 into an atmospheric chamber **4*b* and thus opening at least one frack port 5, the trigger assembly 3 comprising a trigger housing, an activation pin 17 and a release piston 19. The toe valve may further comprise a inlet pressure ports 6 in a first end in communication with the counter mechanism 2 for activating the counter mechanism 2 and in a second end in communication with a wellbore pressure (P1) which may be manipulated from a rig, vessel or by a pressure manipulator in/on a wellhead. The inlet pressure ports 6 may be a perforated sleeve forming a protected chamber where debris and cement fallout can settle on without clogging off inlet pressure ports 6. The device 1 further comprises a fluid separation piston 7 located above the inlet pressure port 6 arranged to ensure that the counter mechanism 2 always operates in clean fluids and a retaining mechanism 10 for liming backward movement of the counter mechanism 2**.

Figure 2:
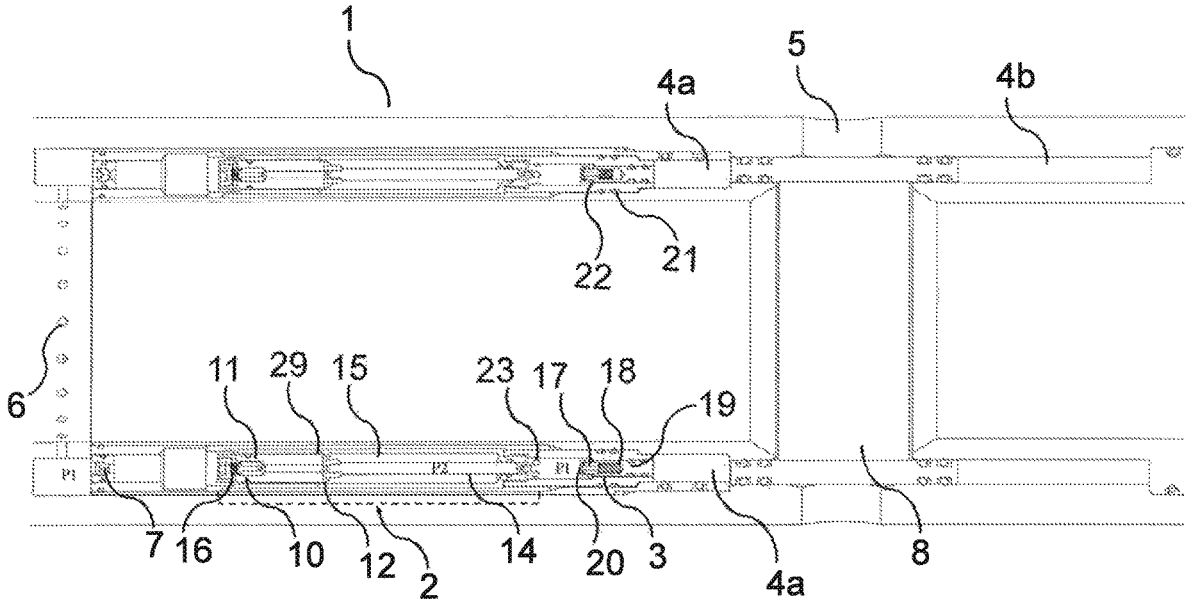
FIG. 2 is a section of the device according of the invention.

FIG. 2 shows a section of FIG. 1. The counter mechanism 2 of the device 1 comprises a cylinder with a closed chamber 15 filled with a compressible fluid having a chamber pressure (P2), preferably a silicone oil, a ratchet assembly 12 which comprises a ratchet piston 11 and a ratchet shaft 14. The ratchet piston 11 and the ratchet shaft 14 may be a single unit or different units welded together or attached to the each other by fastenings means. The counter mechanism 2 further a valve mechanism interconnecting the inlet pressure port 6 and the closed chamber 15 and is arranged for equalizing the pressure a cross the ratchet piston 11. The valve mechanism comprises a valve 16 which may be one-way relief valve or a check valve. The valve 16 may be configured to prevent fluid flow in a first direction from inlet pressure port 6 to the closed chamber 15 and allow fluid flow in a second opposite the first direction. The valve mechanism may be arranged within the ratchet piston 11 or arranged behind the ratchet piston 11.

The device 1 further comprises a trigger assembly 3 arranged between the counter mechanism 2 and the sliding sleeve 8, the trigger assembly 3 comprises an activation pin 17, spring 18 attached to the activation pin 17, a release piston 19 located at the front end of the activation pin 17 and the spring 18 for pushing the sliding sleeve 8 to expose the at least one frack port 5. The release piston 19 may be exposed to a wellbore pressure P1 on the activation pin 17 side by a pressure communication channel 23 which extends from the inlet pressure port 6 and beyond the counter mechanism 2. The trigger assembly 3 further comprises a first atmospheric chamber **4*a* arranged between the release piston 19 and the sliding sleeve 8. The release piston 19 may be configured to slide in the first atmospheric chamber 4*a* when it is pushed by the activation pin 17. The trigger assembly 3 may further comprise a c-clip 20, plurality of O-rings 21 and a locking elements 22 for sealing and locking the trigger assembly 3** in place.

The toe device 1 is open by a predetermined pressure cycle. P1 is the wellbore pressure that is being manipulated by increasing and decreasing it. In the first pressure cycle, the pressure P1 at the inlet pressure port is increased. When P1 is increased, the ratchet assembly 12 is pushed inward and starts to compress the fluid in the closed chamber 15. As the pressure (P1) continues to increase, the ratchet shaft 14 moves further towards the activation pin 17 and the ratchet assembly 12 will compress the compressible fluid in the closed chamber 15 to a point where a further compression of the fluid in closed chamber 15 is not achieved. The first pressure cycle is complete when the compressible fluid can no longer be compressed by increasing P1 and the pressure P2 in the closed chamber 15 is higher than its initial value. To further progress the ratchet assembly 12 towards the activation pin 17, it is preferable to reduce the fluid volume in the closed chamber 15. This is achieved by decreasing the pressure P1 to a value lower than chamber pressure P2. As the pressure P1 decreases to a value lower than the chamber pressure P2 in the closed chamber 15, the fluid in the closed chamber 15 forces the ratchet shaft 14 to move backward towards the inlet pressure port 6. However, backward movement of the ratchet shaft 14 is not desirable and is prevented by the retaining mechanism 29. The valve 16 is in fluid/pressure communication with the closed chamber 15 and is affected by the force of the compressible fluid in the closed chamber, meaning that pressure is applied to the valve 16 by the compressible fluid. The valve 16 may comprise a ball resting on a seat which enables the valve 16 to open when the ball is moved away from its seat. The valve is configured to open when a predetermined pressure difference between P2 and P1, set by the user, is exceeded. Optionally, the valve 16 may be configured to open at a specific predetermined crack-open pressure. When the predetermined pressure difference between P2 and P1 set by the user is exceeded, the valve 16 opens. This results in fluid outflow from the chamber 15, and the pressure difference between P1 and P2 is equalized. After pressure equalization is achieved or nearly achieved, the pressure P1 is increased again to move the ratchet assembly 12 further inward towards the activation pin 17. This pressure increase is counted as the second pressure cycle. As the pressure P1 increases, the ratchet assembly 12 compresses the fluid in the closed chamber 15 and progresses further towards the activation pin 17, since there is less fluid in the closed chamber 15 than there was under the first pressure cycle. This pattern/process is repeated until the ratchet shaft 14 pushes the activation pin 17 away from its position. The activation pin 17 may be is hold in place by a retaining-clip 20 and locking elements 22. When the ratchet shaft 14 engages with the retaining-clip 20, the ratchet shaft 14 pushes the activation pin 17 out of its position towards the release piston 19. The release piston 19 is exposed to wellbore pressure P1 or ratchet assembly pressure on a first end and a first atmospheric chamber 4*a* arranged between the trigger assembly and the sliding sleeve on a second end. The activation pin 17 is configured to force the release piston 19 towards the atmospheric chamber 4*a* to equalize the pressure difference between the first atmospheric chamber 4*a* side and the activation pin 17 side. The atmospheric chamber 4*a,b* is a chamber that holds a pressure of 1 atmosphere (1 bar). The sliding sleeve 8 is configured to move in response to the pressure difference between the first atmospheric chamber 4*a* and the second atmospheric chamber 4*b* arranged opposite the first atmospheric chamber 4*a*. The release piston 19 pushes the sliding sleeve 8 away from the frack ports 5 as the result of pressure equalization between the atmospheric chambers 4*a,b*. After the frack ports 5 in the toe valve 1 are opened, the well is ready for treatment operations, for example fracking.

The toe valve according to the invention is self-calibrating because when the pressure in the downhole changes due to temperature, depth or fluid weights, the closed chamber 15 will equalize to the downhole pressure by means of the valve 16 bleeding off excess volume, or the ratchet assembly 12 moving inward for volume compensation.

Figure 3:
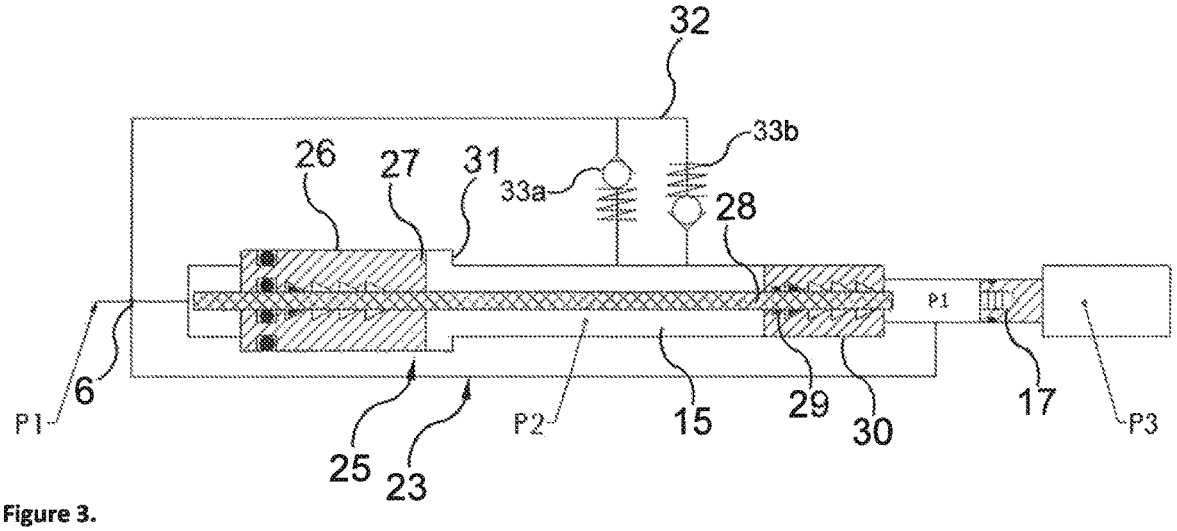
FIG. 3 shows one embodiment of the invention.

In one embodiment of the invention the device 1 comprises another type of counter mechanism. FIG. 3 shows a simplified hydraulic diagram of this embodiment of the invention. The figure shows a pressure, P1, which is the pressure at the rear of the device 1 (wellbore pressure), rear in this regard being the left side. The pressure equalization channel 23 extends from the inlet pressure port 6 and beyond a counter mechanism 25. The pressure equalization channel 13 avoids pressure buildup between the front and the rear of the device 100. P1 is the pressure that is being manipulated by increasing and decreasing it.

In FIG. 3, the counter mechanism 25 comprises the ratchet assembly 26 comprising a ratchet piston 27 and a ratchet shaft 28, the ratchet shaft 28 which is movably connected to the ratchet piston 27, retaining mechanism 29 in contact with the exterior part of the ratchet 28 and a retaining member 30 in contact with the front end of the ratchet. Both the retaining mechanism 29 and the retaining member 30 act/serve to limit backward movement of the ratchet shaft 28. The counter 25 further comprises a retaining shoulder 31 for restricting movement of the ratchet piston 27 and a closed chamber 15 filled with a compressible fluid. The ratchet piston 27 is configured to displace the ratchet shaft 28 in a direction towards the front end of the counter mechanism (inward) and move freely in the other direction (outward). The compressible fluid in the closed chamber 15 is a compressible liquid, preferably silicone oil. The counter mechanism 25 may further comprise resilient elements (not shown) located behind the ratchet piston 27 or behind the ratchet shaft 28. The device further comprises a valve mechanism 32 interconnecting the inlet pressure port 6 and the closed chamber 15 arranged for equalizing the pressure a cross the ratchet piston 27. The valve mechanism 32 comprises a first one-way valve 33*a* and a second one-way valve 33*b* each having one end in fluid communication with the closed chamber 15 and another end in pressure communication with the inlet pressure port 6, the first and the second one-way valves are arranged in opposite directions.

P2, which is shown in FIG. 3, is the pressure in the closed chamber 15. When the pressure at the rear of the device, P1, is increased, the ratchet piston 27 and the ratchet shaft 28 move inward and start to compress the fluid in the closed chamber 15. The pressure in the closed chamber 15 increases as a result of this fluid compression. When the pressure difference between P1 and P2 exceeds a predetermined value, the first valve 33*a* opens to equalize this pressure difference. When the pressure at rear of the device, P1, is decreased and a predetermined pressure difference between P2 and P1 is exceeded, the second valve 33*b* opens to equalize the pressure difference. The backward and the forward movements of the ratchet piston 27 are controlled by P1, P2 and the valves. P3 shown in the figure is the pressure in the atmospheric chamber.

When pressure P1 is increased, the ratchet piston 27 is forced to move inward, compressing the fluid in the closed chamber 15. As the ratchet piston 27 moves inward, it displaces the ratchet shaft 28 inward. As the pressure (P1) is increased, the ratchet piston 27 moves until it is retained by the retaining shoulder 31. The pressure, P1, continues to increase until a predetermined differential pressure value (P1−P2) is exceeded. The first valve 33*a* is configured to open when this predetermined differential pressure value is exceeded. This results in a fluid influx in the closed chamber 15 and pressure equalization in the closed chamber 15 is achieved. After pressure equalization is achieved, the ratchet piston 27 is moved back to its original position (outward). This is achieved by decreasing P1 and opening the second valve 33*b*. P1 is decreased until a predetermined differential pressure value between P1 and P2 is exceeded. The second valve 33*b* is configured to open when this predetermined differential pressure value (P2−P1) is exceeded. This result in fluid decompression and fluid outflux from the closed chamber 15 and pressure equalization between P1 & P2.

Outward movement (direction towards the rear of the counter mechanism) of the ratchet piston 27 is achieved when P2 exceeds P1, but before exceeding the predetermined differential pressure to open the second valve 33*b*. As the ratchet piston 27 moves outward, the ratchet shaft 28 is retained by the retaining rings 29 and the retaining member 30, thereby achieving outward movement of the ratchet piston 27 only. One pressure cycle is completed when the ratchet piston 27 is moved back to its original position. This process is repeated until the ratchet shaft 28 reaches an activation pin 17. The ratchet shaft 28 moves towards the activation pin 17 for every pressure cycle until it reaches the activation pin 17 which activates the release piston and the sliding sleeve and thus opening the frack ports.

The valves 33*a,b* are configured to equalize pressure in the closed chamber 15. The valves operate in opposite directions and open at a predetermined differential pressure. The term "predetermined" means a pressure value that is preset by the manufacturer or the user. Differential pressure in this regard means a pressure difference between P1 and P2 or vice versa, P1–P2 or P2–P1. In the present application, the differential pressure may also be referred to as crack-open pressure. In one embodiment of the invention, the first valve 33*a* is configured to open when P1–P2=80 bar (crack-open pressure). When the crack-open pressure is exceeded, the valve opens to equalize the pressure in the closed chamber 15 by pumping more fluid into the chamber 15. In the same embodiment of the invention, the second valve 33*b* has a crack-open pressure of 20 bar (P2–P1=20 bar). As P2 exceeds P1, but before P2 exceeds the crack-open pressure of the second valve 2*b*, the ratchet piston 27 moves outward, because P2 is larger than P1. It should be understood that the pressure difference that is needed to achieve outward movement of the ratchet piston 27 should be greater than its frictional force. After P2 exceeds the crack-open pressure of the second valve (20 bar), the second valve 33*b* opens to equalize the pressure in the closed chamber by bleeding off fluid from the chamber 15. In this embodiment, the valves operate at crack open pressures of 80 bar and 20 bar, respectively. It should be understood that the valves can be designed to operate at other crack-open pressures than the values used in this embodiment. The values used in this embodiment are presented for the reader's convenience and shall not be understood as limiting.

Due to the valves, the device according to this embodiment of the invention is self-calibrating. The device can be activated regardless of the pressure range in the well. The activation of the device is controlled by the differential pressure between the fluid in the closed chamber, P2, and the surrounding pressure, P1, which is remotely manipulated.

While the invention has been described with reference to the embodiment illustrated, it should be understood that modifications and/or additions can be made to the device, which remain within the field and scope of the invention.

The invention claimed is:

1. A toe valve comprising;

a housing having an interior and exterior;

a sliding sleeve;

a counter mechanism comprising:

a cylinder, a ratchet piston with first and second ends, and a ratchet shaft connected to the second end, a trigger assembly comprising:

a trigger housing, and a release piston, wherein the trigger assembly is arranged between the counter mechanism and the sliding sleeve, and wherein the release piston is configured to activate the sliding sleeve, and the ratchet shaft is configured to activate the release piston, wherein the toe valve further comprises:

a closed chamber enclosing the ratchet shaft and defined at least partly by the cylinder comprising a chamber fluid with a chamber pressure;

an inlet pressure port configured to be in communication with a wellbore fluid with a wellbore pressure, and wherein the first end of the ratchet piston is in fluid communication with the inlet pressure port, wherein the ratchet piston is configured to move towards the trigger assembly to a new position and compress the chamber fluid when the wellbore pressure is larger than the chamber pressure;

a retaining mechanism configured to retain the ratchet shaft in the new position; and a valve mechanism interconnecting the first and second ends of the ratchet piston and configured for equalizing the pressure across the ratchet piston.

2. The toe valve according to claim 1, further comprising at least one frack port having a perforation extending from the interior of the housing to the exterior of the housing wherein the sliding sleeve is arranged to cover the at least one frack port.

3. The toe valve according to claim 1, wherein the valve mechanism is arranged within the ratchet piston.

4. The toe valve according to claim 3, wherein the valve mechanism comprises a valve configured to prevent fluid flow in a first direction from the inlet pressure port to the closed chamber and allow fluid flow in a second opposite the first direction.

5. The toe valve according to claim 4, wherein the valve is a one-way relief valve.

6. The toe valve according to claim 4, wherein the valve comprises a ball arranged to rest on a seat.

7. The toe valve according to claim 6, wherein the valve is configured to open when the ball is moved away from the seat.

8. The toe valve according to claim 1, wherein the valve mechanism comprises a first one-way valve and a second one-way valve each having one end in fluid communication with the closed chamber and another end in pressure communication with the inlet pressure port, wherein the first and the second one-way valves are arranged in opposite directions.

9. The toe valve according to claim 8, wherein the first valve is configured to open when pressure at the inlet pressure port is a predetermined value greater than the chamber pressure in the closed chamber.

10. The toe valve according to claim 8, wherein the second valve is configured to open when pressure at the inlet pressure port is a predetermined value less than the chamber pressure in the closed chamber.

11. The toe valve according to claim 1, wherein the valve mechanism is configured to equalize pressure in the closed chamber when a predetermined differential pressure value between P1 and P2 is exceeded.

12. The toe valve according to claim 1, wherein the fluid in the closed chamber is a compressible fluid.

13. The toe valve according to claim 12, wherein the compressible fluid in the closed chamber is silicone oil.

14. The toe valve according to claim 1, wherein the cylinder further comprises:

a retaining member configured to limit movement of the ratchet shaft towards the inlet pressure port.

15. The toe valve according to claim 1, wherein the cylinder further comprises:

a retaining shoulder configured to limit the movement of the ratchet piston towards the closed chamber.

16. The toe valve according to claim 1, wherein the toe valve further comprises:

an activation pin configured to release the release piston, and a first atmospheric chamber arranged between the trigger assembly and the sliding sleeve, wherein the release piston is configured to compress the first atmospheric chamber when released by the activation pin.

17. The toe valve according to claim 1, further comprising a pressure equalization channel which extends from the inlet pressure port and beyond the ratchet piston assembly.

18. The toe valve according to claim 1, further comprising a second atmospheric chamber arranged opposite the first atmospheric chamber relative to the sliding sleeve, wherein the sliding sleeve is configured to move in response to pressure difference between the first atmospheric chamber and the second atmospheric chamber.

19. A method of opening a toe valve comprising;

a housing having an interior and exterior, a sliding sleeve, a counter mechanism comprising:

a cylinder, a ratchet piston with first and second ends, and a ratchet shaft connected to the second end, a trigger assembly comprising:

a trigger housing, and a release piston, wherein the trigger assembly is arranged between the counter mechanism and the sliding sleeve, and wherein the toe valve further comprises:

a closed chamber enclosing the ratchet shaft and defined at least partly by the cylinder comprising a chamber fluid with a chamber pressure, an inlet pressure port configured to be in communication with a wellbore fluid with a wellbore pressure, and wherein the first end of the ratchet piston is in fluid communication with the inlet pressure port, a retaining mechanism, and a valve mechanism interconnecting the first and second ends of the ratchet piston, the method comprising the steps of;

activating the counter mechanism, wherein the activation of the counter mechanism comprising the steps of;

a) increasing wellbore pressure at the inlet pressure port to push the ratchet piston towards the trigger assembly whereby the ratchet piston compresses the fluid in the closed chamber, and to move the ratchet shaft is to a new position, b) retaining the ratchet shaft in the new position by the retaining mechanism;

c) continue increasing wellbore pressure;

d) decreasing the wellbore pressure lower than chamber pressure;

e) open the valve mechanism to equalize pressure across the ratchet piston by releasing fluid from the closed chamber;

f) repeating steps a) to e) until the ratchet shaft engages with the activation pin and forces the activation pin from its position towards the release piston;

activating the trigger assembly, wherein the activation of the trigger assembly comprising the steps of;

pushing the release piston with the activation pin towards the first atmospheric chamber, thereby increasing the pressure in the atmospheric chamber; and pushing the sliding sleeve away from the at least one frack port towards the second atmospheric chamber with the release piston.

20. A method of opening a toe valve comprising;

a housing having an interior and exterior, a sliding sleeve, a counter mechanism comprising:

a cylinder, a ratchet piston with first and second ends, and a ratchet shaft connected to the second end, a trigger assembly comprising:

a trigger housing, and a release piston, wherein the trigger assembly is arranged between the counter mechanism and the sliding sleeve, and wherein the toe valve further comprises:

a closed chamber enclosing the ratchet shaft and defined at least partly by the cylinder comprising a chamber fluid with a chamber pressure, an inlet pressure port configured to be in communication with a wellbore fluid with a wellbore pressure, and wherein the first end of the ratchet piston is in fluid communication with the inlet pressure port, a retaining mechanism, and a valve mechanism interconnecting the first and second ends of the ratchet piston, the method comprising the steps of;

activating the counter mechanism, wherein the activation of the counter mechanism comprising the steps of;

a) increasing wellbore pressure at the inlet pressure port to push the ratchet piston towards the trigger assembly whereby the ratchet piston compresses the fluid in the closed chamber, and to move the ratchet shaft is to a new position, b) retaining the ratchet shaft in the new position by the retaining mechanism;

c) continue increasing wellbore pressure a predetermined pressure difference greater than chamber pressure;

d) open a first valve of the valve mechanism to equalize pressure across the ratchet piston by allowing fluid into the closed chamber;

e) decreasing the wellbore pressure a predetermined pressure difference lower than chamber pressure;

f) open a second valve of the valve mechanism to equalize pressure across the ratchet piston by releasing fluid from the closed chamber;

g) repeating steps a) to f) until the ratchet shaft engages with the activation pin and forces the activation pin from its position towards the release piston;

activating the trigger assembly, wherein the activation of the trigger assembly comprising the steps of;

pushing the release piston with the activation pin towards the first atmospheric chamber, thereby increasing the pressure in the atmospheric chamber; and pushing the sliding sleeve away from the at least one frack port towards the second atmospheric chamber with the release piston.

21. The method according to claim 20, wherein in step f), the ratchet piston is pushed back to its start position and the ratchet shaft is retained by the retaining mechanism.

* * * * *